US010811788B2

(12) United States Patent
Shinohara

(10) Patent No.: US 10,811,788 B2
(45) Date of Patent: Oct. 20, 2020

(54) ELECTRIC WIRE WITH TERMINAL

(71) Applicant: Yazaki Corporation, Tokyo (JP)

(72) Inventor: Junya Shinohara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/362,448

(22) Filed: Mar. 22, 2019

(65) Prior Publication Data

US 2019/0305440 A1 Oct. 3, 2019

(30) Foreign Application Priority Data

Mar. 29, 2018 (JP) ..... 2018-063658

(51) Int. Cl.

| | |
|---|---|
| ***H01R 4/18*** | (2006.01) |
| ***H01R 4/62*** | (2006.01) |
| ***H01R 13/03*** | (2006.01) |
| ***H01R 13/11*** | (2006.01) |
| ***H01R 43/048*** | (2006.01) |
| ***H01R 43/16*** | (2006.01) |
| ***H01R 43/05*** | (2006.01) |
| ***H01R 43/28*** | (2006.01) |

(52) U.S. Cl.

CPC ..... *H01R 4/183* (2013.01); *H01R 4/185* (2013.01); *H01R 4/62* (2013.01); *H01R 13/03* (2013.01); *H01R 13/114* (2013.01); *H01R 43/048* (2013.01); *H01R 43/05* (2013.01); *H01R 43/16* (2013.01); *H01R 43/28* (2013.01)

(58) Field of Classification Search

CPC ..... H01R 4/183; H01R 4/185

USPC ..... 877/877, 882

See application file for complete search history.

(56) References Cited

U.S. PATENT DOCUMENTS

| | | | | |
|---|---|---|---|---|
| 2,854,648 | A * | 9/1958 | Berg | H01R 4/188 439/867 |
| 9,236,667 | B2 * | 1/2016 | Shimizu | H01R 4/183 |
| 9,484,640 | B2 * | 11/2016 | Yamaji | H01R 4/62 |
| 9,667,011 | B2 * | 5/2017 | Sato | H01R 4/70 |

(Continued)

FOREIGN PATENT DOCUMENTS

| | | |
|---|---|---|
| CN | 104604030 A | 5/2015 |
| CN | 105765789 A | 7/2016 |

(Continued)

*Primary Examiner* — Neil Abrams

(74) *Attorney, Agent, or Firm* — Kenealy Vaidya LLP

(57) ABSTRACT

An electric wire with a terminal includes: an electric wire including a conductor portion having conductivity and an insulator portion which covers the outside of the conductor portion and has a cut away or tapered portion at its leading face; a terminal connection portion electrically connected to a counterpart terminal; a conductor crimp portion crimped to the conductor portion; and a sheath crimp portion separated from the conductor crimp portion and crimped to the insulator portion. The sheath crimp portion includes a second base portion on which the insulator portion is mounted and a second barrel piece portion crimped with the insulator portion wrapped. In the insulator portion, the distance from an end on the conductor crimp portion side to the conductor crimp portion is relatively short, and the distance from an end on the conductor crimp portion side to the conductor crimp portion is relatively long.

2 Claims, 8 Drawing Sheets

(56) References Cited

U.S. PATENT DOCUMENTS

| | | | | |
|---|---|---|---|---|
| 9,774,099 | B2 | 9/2017 | Aoki et al. | |
| 2013/0052887 | A1* | 2/2013 | Inoue | H01R 4/70 439/877 |
| 2015/0126080 | A1 | 5/2015 | Shimizu et al. | |
| 2016/0254603 | A1 | 9/2016 | Terasaka | |
| 2017/0005417 | A1 | 1/2017 | Aoki et al. | |
| 2017/0077618 | A1 | 3/2017 | Tago et al. | |
| 2018/0076532 | A1 | 3/2018 | Iwasawa et al. | |
| 2019/0165489 | A1* | 5/2019 | Sato | H01R 3/0484 |
| 2019/0305440 | A1* | 10/2019 | Shinohara | H01R 3/048 |

FOREIGN PATENT DOCUMENTS

| | | | |
|---|---|---|---|
| CN | 106170891 | A | 11/2016 |
| JP | 2014-53160 | A | 3/2014 |
| JP | 6131893 | B2 | 5/2017 |

* cited by examiner

ELECTRIC WIRE WITH TERMINAL

CROSS-REFERENCE TO RELATED APPLICATION(S)

The present application claims priority to and incorporates by reference the entire contents of Japanese Patent Application No. 2018-063658 filed in Japan on Mar. 29, 2018.

BACKGROUND OF THE INVENTION

1. Field of the Invention

The present invention relates to an electric wire with a terminal.

2. Description of the Related Art

As a conventional crimp terminal which is included in a wire harness used in a vehicle, for example, Japanese Patent No. 6131893 discloses an electric wire with a terminal which is provided with an electric wire fixing portion in which a terminal fitting is fixed to a covered electric wire. In the electric wire with a terminal, a connected portion between an electric wire conductor and the terminal fitting is coated with an anticorrosive material, and a sealing agent is applied to the electric wire fixing portion.

The above electric wire with a terminal described in Japanese Patent No. 6131893 is susceptible to improvement in reducing corrosion while reducing the manufacturing cost.

SUMMARY OF THE INVENTION

The present invention has been made in view of the above circumstances, and an object thereof is to provide an electric wire with a terminal capable of reducing corrosion while reducing the manufacturing cost.

In order to achieve the above mentioned object, an electric wire with a terminal according to one aspect of the present invention includes an electric wire that includes a conductor portion having conductivity, and an insulator portion covering an outside of the conductor portion and having an insulating property; a terminal connection portion electrically connected to a counterpart terminal; a conductor crimp portion that is crimped to the conductor portion exposed from the insulator portion; and a sheath crimp portion separated from the conductor crimp portion, and crimped to the insulator portion, wherein the sheath crimp portion includes a base portion on which the insulator portion is mounted, and a barrel piece portion extending from the base portion and crimped with the insulator portion wrapped between the barrel piece portion and the base portion, and the insulator portion is in contact with the base portion and the barrel piece portion, and a distance from an end on the conductor crimp portion side to the conductor crimp portion is relatively short at a side in contact with the barrel piece portion, and a distance from an end on the conductor crimp portion side to the conductor crimp portion is relatively long at a side in contact with the base portion with respect to an extending direction of the electric wire, in a state in which the sheath crimp portion is crimped to the insulator portion.

According to another aspect of the present invention, in the electric wire with a terminal, it is possible to configure that the insulator portion includes a cut-away portion at the side in contact with the base portion, and the cut-away portion is located on the base portion side in a state in which the sheath crimp portion is crimped to the insulator portion.

According to still another aspect of the present invention, in the electric wire with a terminal, it is possible to configure that the insulator portion further includes a slit, and the slit is formed on the insulator portion at a position opposite to a position of the cut-away portion across the conductor portion, extends in a direction intersecting the extending direction of the electric wire, and has a depth less than a thickness of the insulator portion.

According to still another aspect of the present invention, in the electric wire with a terminal, it is possible to configure that an end face of the cut-away portion on the conductor crimp portion side in the extending direction of the electric wire extends along a face inclined with respect to a face perpendicular to the extending direction.

In order to achieve the above mentioned object, an electric wire with a terminal according to still another aspect of the present invention includes an electric wire that includes a conductor portion having conductivity, and an insulator portion covering an outside of the conductor portion and having an insulating property; a terminal connection portion electrically connected to a counterpart terminal; a conductor crimp portion crimped to the conductor portion exposed from the insulator portion; and a sheath crimp portion separated from the conductor crimp portion, and crimped to the insulator portion, wherein the sheath crimp portion includes a base portion on which the insulator portion is mounted, and a barrel piece portion extending from the base portion and crimped with the insulator portion wrapped between the barrel piece portion and the base portion, and the insulator portion includes a tapered portion whose outer diameter gradually decreases toward a tip of the exposed conductor portion between the conductor crimp portion and the sheath crimp portion in an extending direction of the electric wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinbelow, embodiments according to the present invention will be described in detail with reference to the drawings. Note that the present invention is not limited by the embodiments. In addition, elements in the following embodiments include elements easily replaceable by those skilled in the art, or substantially identical elements.

First Embodiment

Figure 1:
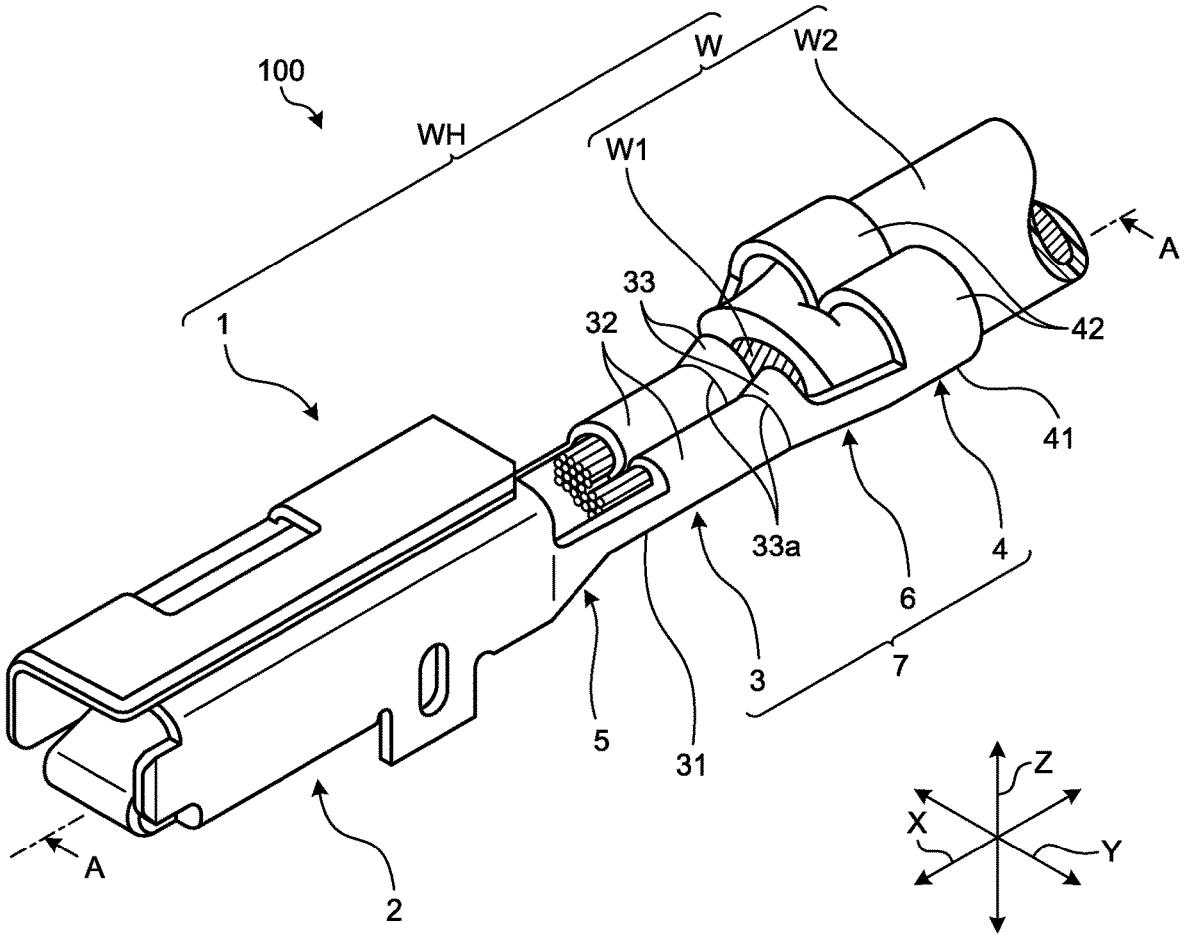
FIG. 1 is a partial perspective view illustrating a schematic configuration of an electric wire with a terminal according to an embodiment.
Figure 2:
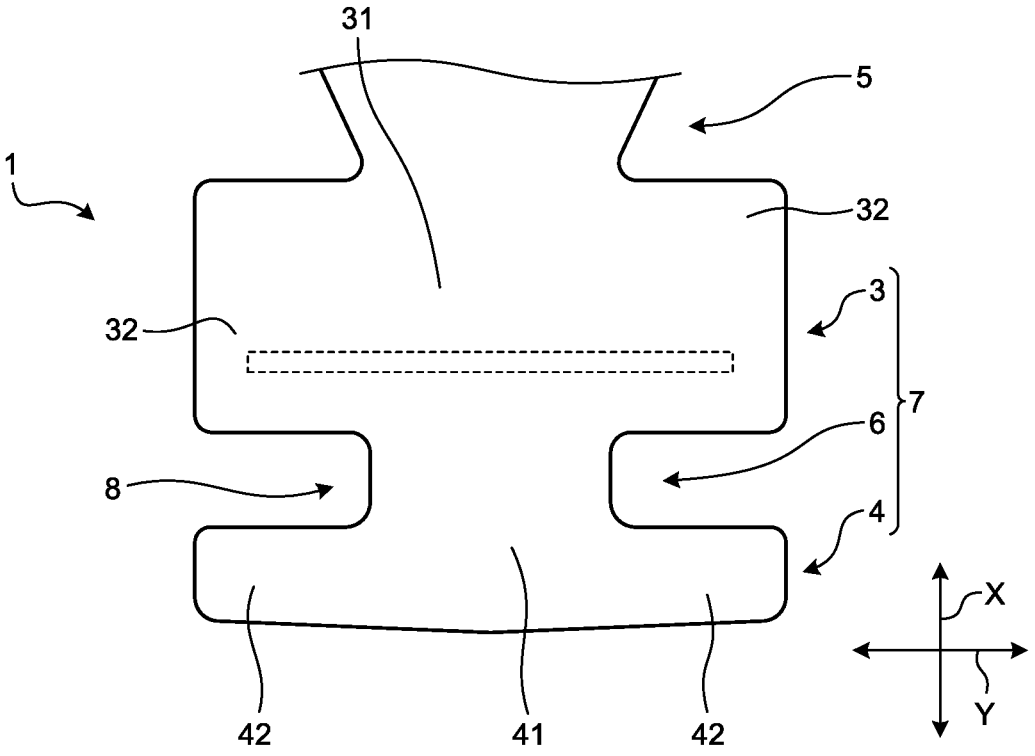
FIG. 2 is a partial plan view illustrating a state in which a crimp terminal of the electric wire with a terminal according to the embodiment is developed.

FIG. 1 is a partial perspective view illustrating a schematic configuration of an electric wire with a terminal according to an embodiment. FIG. 2 is a partial plan view illustrating a state in which a crimp terminal of the electric wire with a terminal according to the embodiment is developed, in other words, corresponds to a partial plan view illustrating a state in which a metal sheet before pressing of the crimp terminal is developed. An electric wire with a terminal 100 of the present embodiment illustrated in FIGS. 1 and 2 is, for example, a terminal fitting which is applied to a wire harness WH used in a vehicle. The wire harness WH is, for example, a collective component which is obtained by bundling a plurality electric wires W used in power supply and signal communication for connection between devices mounted on the vehicle so that the electric wires W are connected to the devices at once through a connector. The wire harness WH is provided with the electric wire W and a crimp terminal 1 which is attached to an end of the electric wire W. The electric wire W includes, for example, a conductor portion W1 which has a linear shape and has conductivity, and an insulator portion W2 which covers the outside of the conductor portion W1 and has an insulating property. The conductor portion W1 of the present embodiment is, for example, a core wire formed by bundling a plurality of elemental wires of conductive metal such as copper, a copper alloy, aluminum, or an aluminum alloy. The conductor portion W1 may be a twisted core wire formed by twisting a plurality of elemental wires. The insulator portion W2 is an electric wire covering which covers the outer peripheral side of the conductor portion W1. The insulator portion W2 is formed, for example, by extrusion-molding an insulating resin material (e.g., PP, PVC, or crosslinked PE, appropriately selected taking into consideration wear resistance, chemical resistance, and heat resistance). In the electric wire W, the insulator portion W2 is stripped off at least on one end of the conductor portion W1 so that the one end of the conductor portion W1 is exposed from the insulator portion W2, and the crimp terminal 1 is attached to the exposed end of the conductor portion W1. In the present embodiment, the electric wire W extends with substantially the same diameter in an extending direction in which the electric wire W linearly extends. The cross-sectional shape (the cross-sectional shape in a direction intersecting the extending direction) of the conductor portion W1 is a substantially circular shape, the cross-sectional shape of the insulator portion W2 is a substantially annular shape, and the electric wire W has a substantially circular cross-sectional shape as a whole. In addition, the wire harness WH may further include a grommet, a protector, a fixture, and the like. Hereinbelow, the configuration of the crimp terminal 1 will be described in detail with reference to each of the drawings.

In the following description, among a first direction, a second direction, and a third direction which intersect each other, the first direction is referred to as the "axial direction X", the second direction is referred to as the "width direction Y", and the third direction is referred to as the "height direction Z". In the present embodiment, the axial direction X, the width direction Y, and the height direction Z are substantially perpendicular to each other. The axial direction X typically corresponds to the extending direction of the electric wire W to which the crimp terminal 1 is attached and corresponds to a direction in which a terminal connection portion 2, a conductor crimp portion 3, and a sheath crimp portion 4 of the crimp terminal 1 are disposed side by side. The width direction Y and the height direction Z correspond to intersecting directions intersecting the axial direction X. Further, each of the directions used in the following description indicates a direction in a state in which the elements are assembled to each other, unless otherwise noted.

The crimp terminal 1 is provided with the terminal connection portion 2, the conductor crimp portion 3, the sheath crimp portion 4, a first coupling portion 5, and a second coupling portion 6. The entire crimp terminal 1 is integrally made of conductive metal such as copper, a copper alloy, aluminum, or an aluminum alloy. For example, the crimp terminal 1 is formed by pressing and bending a single metal sheet which is punched into a shape corresponding to each of the portions including the terminal connection portion 2, the conductor crimp portion 3, the sheath crimp portion 4, the first coupling portion 5, and the second coupling portion 6, so that the portions are integrally formed in three dimensions. In the crimp terminal 1, the terminal connection portion 2, the first coupling portion 5, the conductor crimp portion 3, the second coupling portion 6, and the sheath crimp portion 4 are disposed side by side in this order from one side to the other side in the axial direction X and coupled to each other. That is, the first coupling portion 5 couples the terminal connection portion 2 and the conductor crimp portion 3 to each other. The second coupling portion 6 couples the conductor crimp portion 3 and the sheath crimp portion 4 to each other. The conductor crimp portion 3 is coupled to the terminal connection portion 2 and the sheath crimp portion 4 at intervals through the first coupling portion 5 and the second coupling portion 6 at both sides in the axial direction X. In the present embodiment, the conductor crimp portion 3, the sheath crimp portion 4, and the second coupling portion 6 constitute an electric wire connecting portion 7 which electrically connects the crimp terminal 1 and the end of the electric wire W to each other. The electric wire connecting portion 7 of the present embodiment constitutes a so-called separate barrel type crimp portion in which the conductor crimp portion 3 and the sheath crimp portion 4 are separated from each other through the second coupling portion 6. In the crimp terminal 1, the terminal connection portion 2 and the electric wire connecting portion 7 are electrically connected through the first coupling portion 5, and the terminal connection portion 2 and the conductor portion W1 of the electric wire W are electrically connected so as to be brought into conduction through the electric wire connecting portion 7.

The terminal connection portion 2 is electrically connected to a counterpart terminal (not illustrated). The terminal connection portion 2 may have a male terminal shape or a female terminal shape. The terminal connection portion 2 of the present embodiment is illustrated as having a female terminal shape and electrically connected to the counterpart terminal having a male terminal shape.

The conductor crimp portion 3 is swaged and crimped to the conductor portion W1 of the electric wire W and electrically connected to the conductor portion W1. The conductor crimp portion 3 includes a first base portion 31 as a conductor crimp portion base portion and a pair of first barrel piece portions 32 as a conductor crimp portion barrel piece portion. The first base portion 31 is a plate-like portion on which the end of the conductor portion W1 of the electric wire W is mounted. The terminal connection portion 2 is coupled to one side in the axial direction X of the first base portion 31 through the first coupling portion 5, and the sheath crimp portion 4 is coupled to the other side of the first base portion 31 through the second coupling portion 6. In the present embodiment, the first base portion 31 is coupled to a second base portion 41 (described below) of the sheath crimp portion 4 through the second coupling portion 6. The first coupling portion 5, the first base portion 31, the second coupling portion 6, and the second base portion 41 are coupled to each other to constitute a bottom plate portion 8 which continuously extends in the axial direction X. The pair of first barrel piece portions 32 extends in a band shape from the first base portion 31 to both sides in the width direction Y. The pair of first barrel piece portions 32 is swaged and crimped with the conductor portion W1 wrapped between the pair of first barrel piece portions 32 and the first base portion 31. The pair of first barrel piece portions 32 is separated from the terminal connection portion 2 and the sheath crimp portion 4 with respect to the axial direction X. Before the pair of first barrel piece portions 32 is crimped to the conductor portion W1, the pair of first barrel piece portions 32 is formed into a substantially U-shape together with the first base portion 31 by bending the first base portion 31. The first barrel piece portions 32 of the present embodiment are formed with substantially the same distance from the base on the first base portion 31 side to the tip so that the first barrel piece portions 32 crimped to the conductor portion W1 do not overlap each other. Further, each of the first barrel piece portions 32 includes a bell-mouth portion 33 at the end on the sheath crimp portion 4 side. The bell-mouth portion 33 is a portion for preventing the conductor portion W1 from being scratched by an edge on the inner face side of the end of each of the first barrel piece portions 32 when the pair of first barrel piece portions 32 is crimped with the conductor portion W1 wrapped between the pair of first barrel piece portions 32 and the first base portion 31. The bell-mouth portion 33 expands from a base end 33*a* toward the end on the sheath crimp portion 4 side in the axial direction X so as to be gradually away from the conductor portion W1. That is, the bell-mouth portion 33 obliquely expands outward from the base end 33*a* toward the end on the sheath crimp portion 4 side in the axial direction X so as to escape from the outer periphery of the conductor portion W1.

The sheath crimp portion 4 is swaged and crimped to the insulator portion W2 of the electric wire W. The sheath crimp portion 4 includes the second base portion 41 as a sheath crimp portion base portion and a pair of second barrel piece portions 42 as a sheath crimp portion barrel piece portion. The second base portion 41 is a plate-like portion on which the end of the insulator portion W2 of the electric wire W is mounted. As described above, the first base portion 31 of the conductor crimp portion 3 is coupled to one side in the axial direction X of the second base portion 41 through the second coupling portion 6. As described above, the second base portion 41 constitutes the bottom plate portion 8 together with the first coupling portion 5, the first base portion 31, and the second coupling portion 6. The pair of second barrel piece portions 42 extends in a band shape from the second base portion 41 to both sides in the width direction Y. The pair of second barrel piece portions 42 is swaged and crimped with the insulator portion W2 wrapped between the pair of second barrel piece portions 42 and the second base portion 41. The pair of second barrel piece portions 42 is separated from the sheath crimp portion 4 with respect to the axial direction X, that is, provided as a separate body separately from the pair of first barrel piece portions 32. Before the pair of second barrel piece portions 42 is crimped to the insulator portion W2, the pair of second barrel piece portions 42 is formed into a substantially U-shape together with the second base portion 41 by bending the second base portion 41. The second barrel piece portions 42 of the present embodiment are formed with substantially the same distance from the base on the second base portion 41 side to the tip so that the second barrel piece portions 42 crimped to the insulator portion W2 do not overlap each other.

The crimp terminal 1 configured in the above manner is swaged and crimped to the electric wire W while deforming the conductor crimp portion 3 and the sheath crimp portion 4 using an anvil as a lower mold and a crimper as an upper mold. That is, in the crimp terminal 1, the conductor portion W1 of the electric wire W is mounted on the first base portion 31 so that the conductor portion W1 is located between the first barrel piece portions 32 and the insulator portion W2 of the electric wire W is mounted on the second base portion 41 so that the insulator portion W2 is located between the second barrel piece portions 42 in a state in which the first base portion 31 of the conductor crimp portion 3 and the second base portion 41 of the sheath crimp portion 4 are mounted on a mounting surface of the anvil. In the crimp terminal 1, the crimper which is disposed at a position facing the anvil in the height direction Z presses the pair of first barrel piece portions 32 toward the first base portion 31 and the pair of second barrel piece portions 42 toward the second base portion 41 to gradually bend and deform the pair of first barrel piece portions 32 and the pair of second barrel piece portions 42 inward while relatively approaching the anvil in the height direction Z. Accordingly, in the crimp terminal 1, the conductor crimp portion 3 is crimped with the conductor portion W1 wrapped between the pair of first barrel piece portions 32 and the first base portion 31 and crimped to the conductor portion W1, and the sheath crimp portion 4 is crimped with the insulator portion W2 wrapped between the pair of second barrel piece portions 42 and the second base portion 41 and crimped to the insulator portion W2.

The crimp terminal 1 is pressed and crimped with a part corresponding to the bell-mouth portion 33 treated as an unpressed portion which is not pressed, so that the bell-mouth portion 33 is formed. In this case, when the crimp terminal 1 is crimped with the conductor portion W1 wrapped between the pair of first barrel piece portions 32 and the first base portion 31, the bell-mouth portion 33 makes it possible to prevent the conductor portion W1 from being scratched by the edge on the inner face side of the end of each of the first barrel piece portions 32. Accordingly, the crimp terminal 1 can reduce a stress acting on a part near the base end 33*a* of the bell-mouth portion 33 where the stress is relatively liable to act in the conductor portion W1. As a result, the crimp terminal 1 can more reliably reduce damage of the conductor portion W1. The crimp terminal 1 may not include the bell-mouth portion 33.

Figure 3:
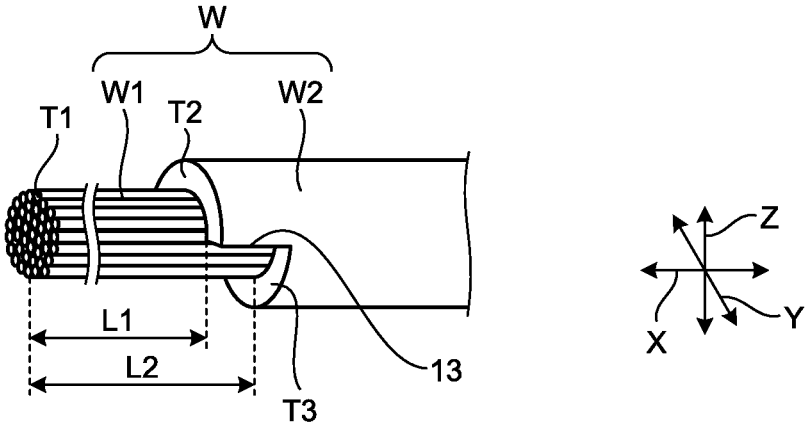
FIG. 3 is a partial perspective view illustrating an example of an end of the electric wire.

FIG. 3 is a partial perspective view illustrating an example of the end of the electric wire W. FIG. 3 illustrates the electric wire W before the crimp terminal 1 is crimped thereto. As illustrated in FIG. 3, the insulator portion W2 of the electric wire W includes a cut-away portion 13. The cut-away portion 13 is formed by stripping off the insulator portion W2 in the axial direction X, that is, the extending direction of the electric wire W. The distance from a tip T1 of the conductor portion W1 to an end face T2 of the insulator portion W2 except the cut-away portion 13 is denoted by L1. The distance from the tip T1 of the conductor portion W1 to an end face T3 of the cut-away portion 13 of the insulator portion W2 is denoted by L2. In this case, the distance L2 is longer than the distance L1. The cut-away portion 13 can be formed by, for example, using a device that applies a blade to the insulator portion W2 to strip off the covering or a device that applies laser light to the insulator portion W2 to remove the covering.

Figure 4:
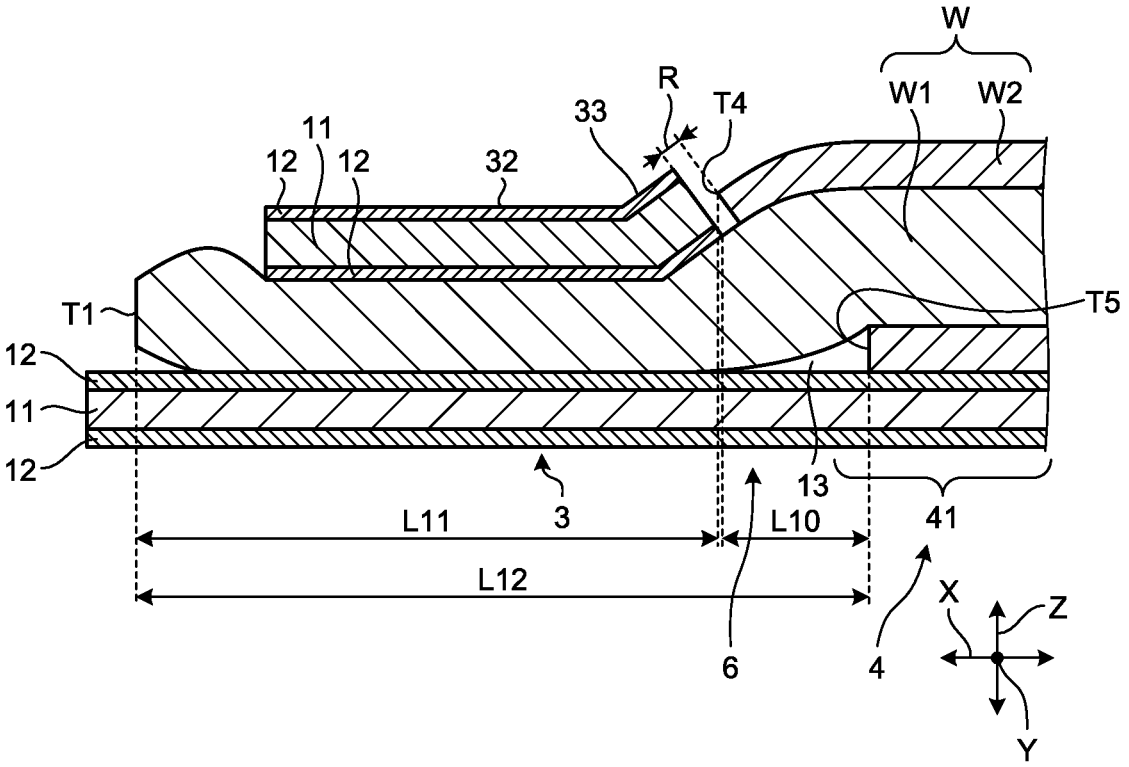
FIG. 4 is a sectional view illustrating a state in which the crimp terminal is crimped to the electric wire illustrated in FIG. 3.

FIG. 4 is a sectional view illustrating a state in which the crimp terminal 1 is crimped to the electric wire W illustrated in FIG. 3. FIG. 4 illustrates an A-A section in FIG. 1. As illustrated in FIG. 4, the cut-away portion 13 is located on the second base portion 41 side in a state in which the sheath crimp portion 4 is crimped to the insulator portion W2. In this state, the insulator portion W2 is in contact with the second base portion 41 and the second barrel piece portions 42 as described above with reference to FIG. 1. In the state illustrated in FIG. 4, in the insulator portion W2, the distance from an end T4 on the conductor crimp portion 3 side to the conductor crimp portion 3, that is, an interval R is relatively short at the side in contact with the second barrel piece portions 42, and the distance L10 from an end T5 on the conductor crimp portion 3 side to the conductor crimp portion 3 is relatively long at the side in contact with the second base portion 41 with respect to the extending direction of the electric wire W. Thus, an end face on the conductor crimp portion 3 side at the side in contact with the second barrel piece portions 42, that is, the end face on the end T4 side is located closer to the conductor crimp portion 3 than an end face on the conductor crimp portion 3 side at the side in contact with the second base portion 41, that is, the end face on the end T5 side is, with respect to the extending direction of the electric wire W. This also means that, in the insulator portion W2, the end T4 on the conductor crimp portion 3 side at the side in contact with the second barrel piece portions 42 extends farther toward the conductor crimp portion 3 than the end T5 on the conductor crimp portion 3 side at the side in contact with the second base portion 41 does, with respect to the extending direction of the electric wire W. Further, a distance L12 from the tip T of the exposed conductor portion W1 to a farthest part of the cut-away portion 13 of the insulator portion W2 in the part in contact with the second base portion 41 is longer than a distance L11 from the tip T1 of the exposed conductor portion W1 to the end of the insulator portion W2. In the state illustrated in FIG. 4, the insulator portion W2 and the bell-mouth portion 33 are close to each other, and the interval R therebetween is small. In this manner, the exposed area of the conductor portion W1 can be reduced by covering a part between the conductor crimp portion 3 and the sheath crimp portion 4 with a part of the insulator portion W2 on the second barrel piece portions 42 side. As illustrated in FIG. 4, a metal sheet constituting the conductor crimp portion 3 includes a base metal 11 and plating portions 12 which are disposed on both faces of the base metal 11. The same applies to each drawing thereafter.

Figure 5:
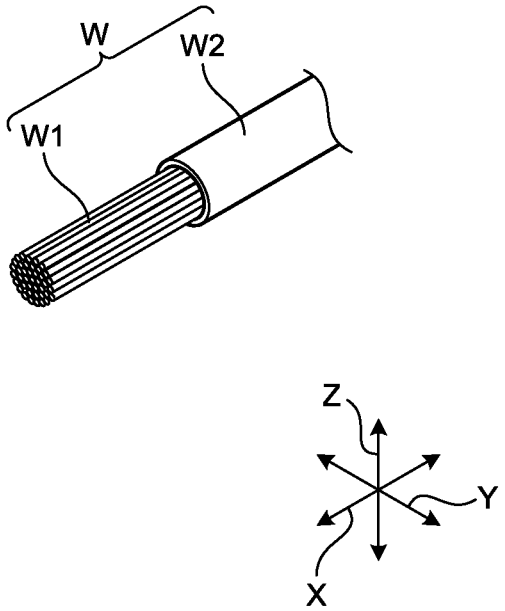
FIG. 5 is a partial perspective view illustrating an end of an electric wire of a reference example.
Figure 6:
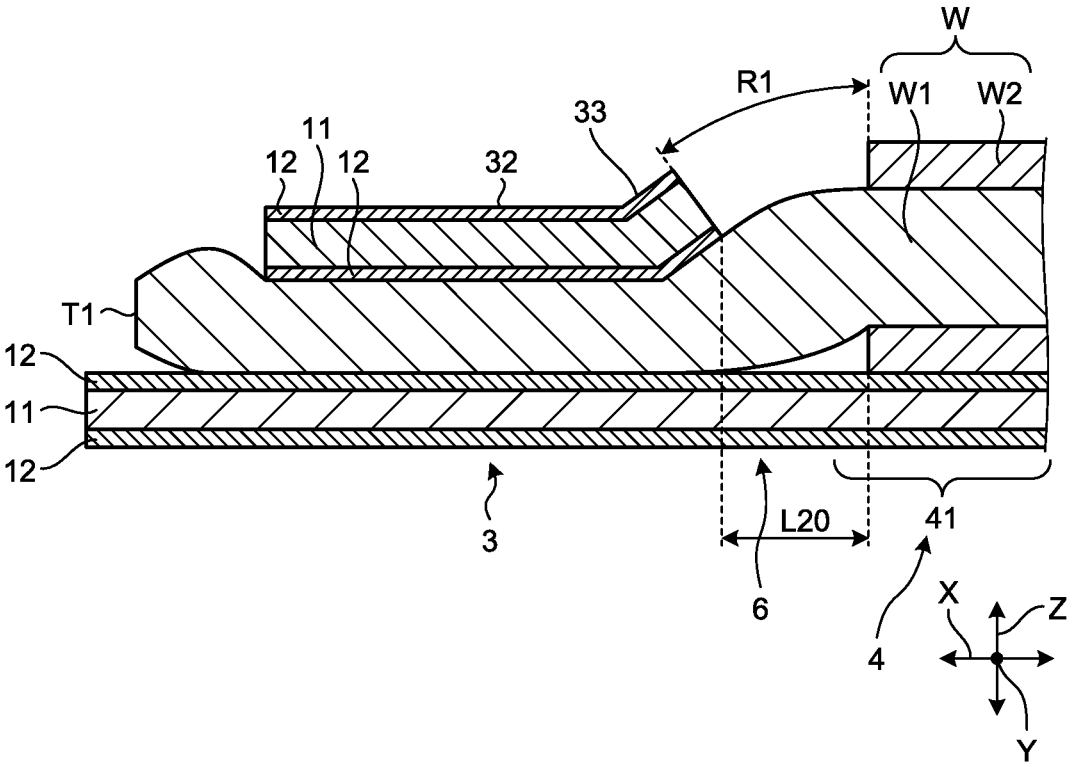
FIG. 6 is a sectional view illustrating an example of a state in which the crimp terminal is crimped to the electric wire illustrated in FIG. 5.
Figure 7:
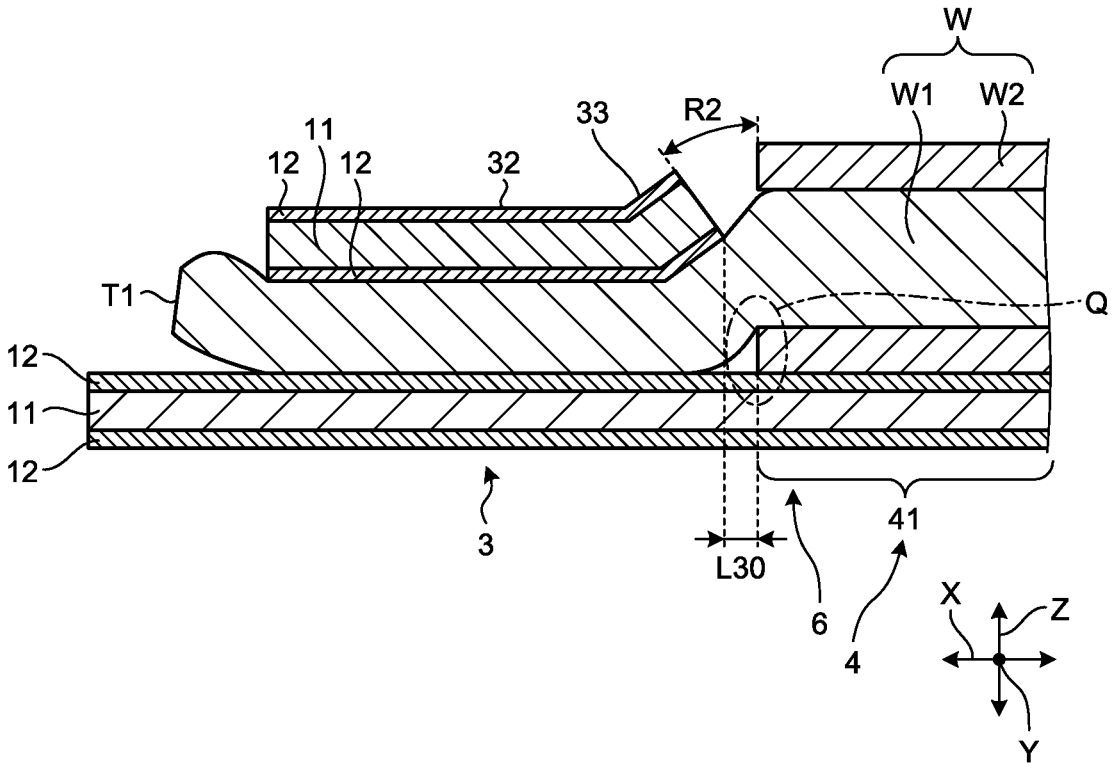
FIG. 7 is a sectional view illustrating an example of the state in which the crimp terminal is crimped to the electric wire illustrated in FIG. 5.

FIG. 5 is a partial perspective view illustrating an example of an end of an electric wire W of a reference example. FIG. 5 illustrates the electric wire W before the crimp terminal 1 is crimped thereto. As illustrated in FIG. 5, the electric wire W of the reference example does not include the cut-away portion 13 described above. FIGS. 6 and 7 are sectional views illustrating examples of a state in which the crimp terminal 1 is crimped to the electric wire W illustrated in FIG. 5. FIGS. 6 and 7 illustrate a section corresponding to the A-A section in FIG. 1. In the example illustrated in FIG. 6, the insulator portion W2 and the bell-mouth portion 33 are away from each other, and an interval R1 therebetween is larger than the interval R illustrated in FIG. 4. A case in which an ionization tendency of the base metal 11 differs from an ionization tendency of the conductor portion W1 will be considered. For example, a case in which the material of the base metal 11 is copper and the material of the conductor portion W1 is aluminum will be considered. In this case, when water enters a gap between the base metal 11 and the conductor portion W1, the conductor portion W1 may suffer corrosion (galvanic corrosion) due to the difference in the ionization tendency. When the interval R1 is large, the possibility of corrosion is high.

Thus, the insulator portion W2 and the bell-mouth portion 33 are brought close to each other at the time of crimping as illustrated in FIG. 7. Accordingly, it is possible to make the interval R2 smaller than the interval R1. Reducing the interval R2 makes it possible to reduce the possibility of corrosion. However, as illustrated in FIG. 7, when the insulator portion W2 and the bell-mouth portion 33 are brought close to each other at the time of crimping, a steep step Q is generated on the conductor portion W1 between the second base portion 41 and the first barrel piece portions 32. When the step Q is generated, a relatively large shear force may act on the conductor portion W1. In particular, when the thickness of the insulator portion W2 is large, the influence of the step Q is large, and a load applied to the conductor portion W1 is large.

As compared to the reference example of FIGS. 6 and 7, according to the above configuration illustrated in FIG. 4, the insulator portion W2 and the bell-mouth portion 33 are close to each other, and the interval R therebetween is small. Thus, it is possible to reduce the exposed area of the conductor portion W1 to reduce the possibility of corrosion. Further, for example, it is possible to reduce the possibility of corrosion without using a sealing agent made of an insulating resin material and reduce corrosion while reducing the manufacturing cost. Further, according to the configuration of FIG. 4, no steep step is generated on the conductor portion W1. Thus, it is possible to prevent a relatively large shear force from acting on the conductor portion W1 due to a steep step.

Further, it is possible to easily set the distance from the tip T1 of the conductor portion W1 to the relationship illustrated in FIG. 4 by providing the cut-away portion 13. Thus, it is possible to reduce the exposed area of the conductor portion W1 to reduce the possibility of corrosion. Further, for example, it is possible to reduce the possibility of corrosion without using a sealing agent made of an insulating resin material and reduce corrosion while reducing the manufacturing cost. Further, since no steep step is generated on the conductor portion W1, it is possible to prevent a relatively large shear force from acting on the conductor portion W1 due to a steep step.

Figure 8:
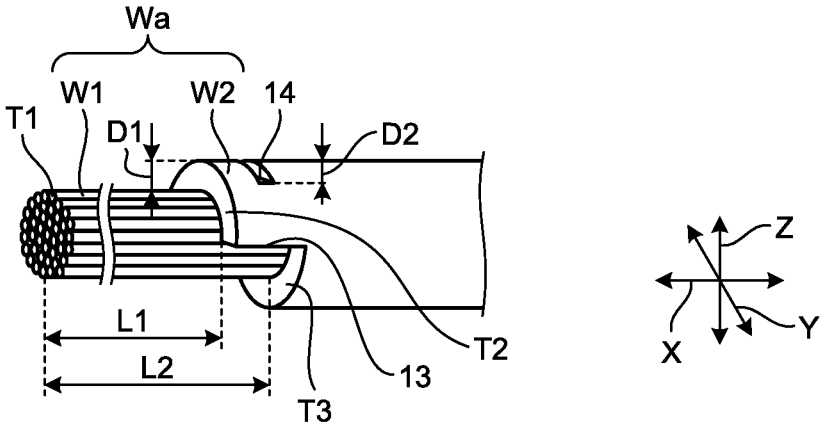
FIG. 8 is a partial perspective view illustrating an example of an end of another electric wire.

FIG. 8 is a partial perspective view illustrating an example of an end of another electric wire Wa. FIG. 8 illustrates the electric wire Wa before the crimp terminal 1 crimped thereto. The electric wire Wa illustrated in FIG. 8 has a configuration in which a slit 14 is added to the electric wire W illustrated in FIG. 3. The slit 14 is formed on the insulator portion W2 at a position opposite to the position of the cut-away portion 13 across the conductor portion W1. The slit 14 extends in a direction intersecting the axial direction X, that is, a direction intersecting the extending direction of the electric wire W, for example, the Y direction. The slit 14 has a depth D2 which is less than a thickness D1 of the insulator portion W2. The slit 14 can be formed by, for example, using a device that applies a blade to the insulator portion W2 to strip off the covering or a device that applies laser light to the insulator portion W2 to remove the covering.

Figure 9:
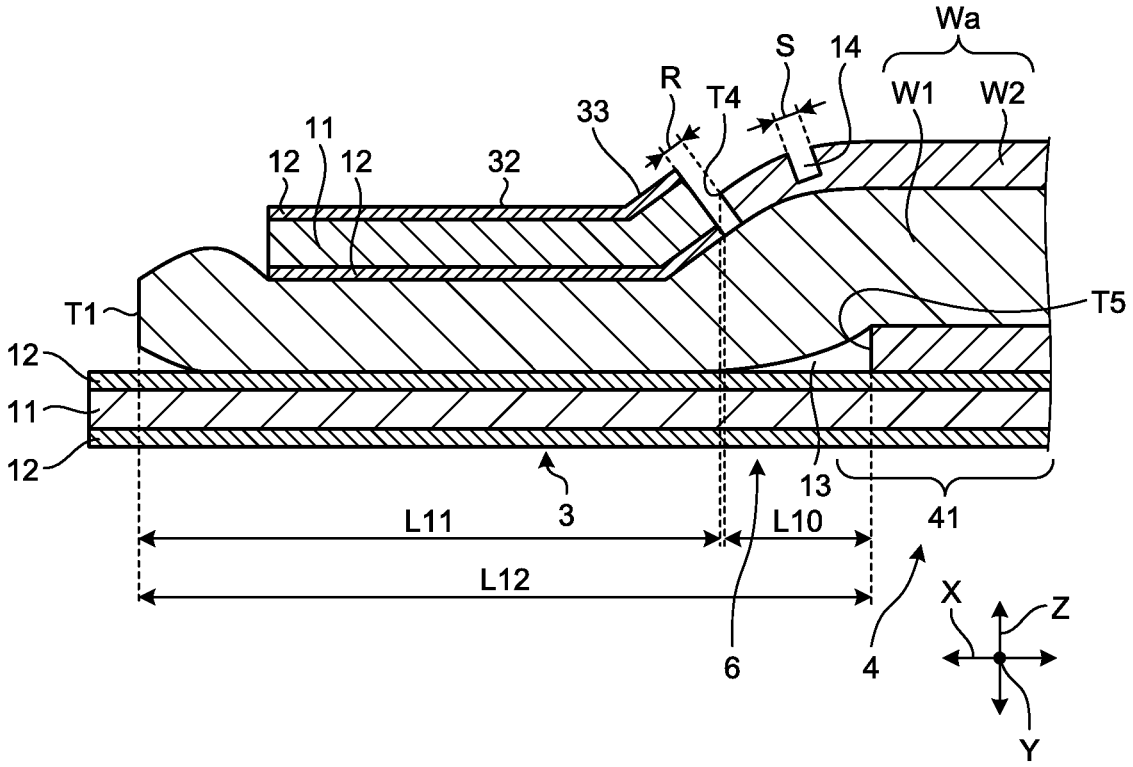
FIG. 9 is a sectional view illustrating a state in which the crimp terminal is crimped to the electric wire illustrated in FIG. 8.

FIG. 9 is a sectional view illustrating a state in which the crimp terminal 1 is crimped to the electric wire Wa illustrated in FIG. 8. FIG. 9 illustrates a section corresponding to the A-A section in FIG. 1. As illustrated in FIG. 9, the cut-away portion 13 is located on the second base portion 41 side in a state in which the sheath crimp portion 4 is crimped to the insulator portion W2. At this time, a width S of the slit 14 expands. Thus, the insulator portion W2 easily follows the conductor portion W1, and the position in the height direction Z changes along the surface of the conductor portion W1. In this state, the distance L12 from the tip T of the exposed conductor portion W1 to the farthest part of the cut-away portion 13 of the insulator portion W2 in the part in contact with the second base portion 41 is longer than the distance L11 from the tip T1 of the exposed conductor portion W1 to the end of the insulator portion W2. In the state illustrated in FIG. 9, the insulator portion W2 and the bell-mouth portion 33 are close to each other, and the interval R therebetween is small. Thus, it is possible to reduce the exposed area of the conductor portion W1 to reduce the possibility of corrosion. Further, for example, it is possible to reduce the possibility of corrosion without using a sealing agent made of an insulating resin material and reduce corrosion while reducing the manufacturing cost. Further, according to the configuration of FIG. 9, no steep step is generated on the conductor portion W1. Thus, it is possible to prevent a relatively large shear force from acting on the conductor portion W1 due to a steep step.

Modifications

Note that the electric wire with a terminal 100 according to the above embodiment of the present invention is not limited to the above embodiment and can be variously modified within a range described in the claims.

Figure 10:
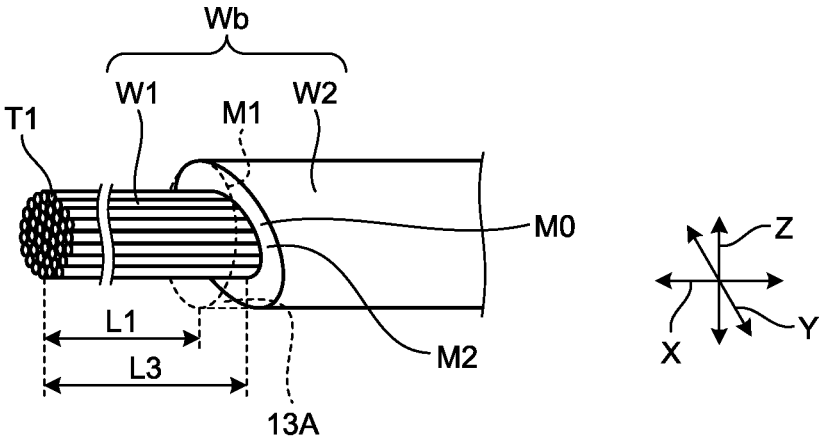
FIG. 10 is a partial perspective view illustrating an example of an end of an electric wire.

The shape of the cut-away portion of the insulator portion W2 may be changed to another shape in order to extend the distance from the tip T of the exposed conductor portion W1 to the end of the insulator portion W2 in the part in contact with the second base portion 41. FIG. 10 is a partial perspective view illustrating an example of an end of an electric wire Wb. FIG. 10 illustrates the electric wire Wb before the crimp terminal 1 is crimped thereto. As illustrated in FIG. 10, an insulator portion W2 of the electric wire Wb includes a cut-away portion 13A. The cut-away portion 13A is formed by stripping off the insulator portion W2 so that an end face M0 on the conductor crimp portion 3 side in the X-axis direction, that is, the extending direction of the electric wire Wb extends along a face M2 which is inclined with respect to a face M1 which is perpendicular to the extending direction of the electric wire Wb. That is, the end face M0 of the insulator portion W2 on the conductor crimp portion 3 side in the extending direction of the electric wire Wb extends along the face M2, and the face M2 is inclined with respect to the face M1 which is perpendicular to the extending direction of the electric wire Wb. The distance from the tip T1 of the conductor portion W1 to the closest part of the insulator portion W2 is denoted by L1. Further, the distance from the tip T1 of the conductor portion W1 to the farthest part of the cut-away portion 13A of the insulator portion W2 is denoted by L3. In this case, the distance L3 is longer than the distance L1. The cut-away portion 13A can be formed by, for example, using a device that applies a blade to the insulator portion W2 to strip off the covering or a device that applies laser light to the insulator portion W2 to remove the covering.

Also when the electric wire Wb illustrated in FIG. 10 is used, the cut-away portion 13A is located on the second base portion 41 side in a state in which the sheath crimp portion 4 is crimped to the insulator portion W2. When the cut-away portion 13A is located on the second base portion 41 side, the distance from the tip of the exposed conductor portion W1 to the farthest part of the cut-away portion 13A of the insulator portion W2 in the part in contact with the second base portion 41 is longer than the distance from the tip T1 of the exposed conductor portion W1 to the end of the insulator portion W2 except the cut-away portion 13A.

Thus, in a manner similar to the case illustrated in FIG. 4, the insulator portion W2 and the bell-mouth portion 33 are close to each other, and the interval R therebetween is small. Thus, it is possible to reduce the exposed area of the conductor portion W1 to reduce the possibility of corrosion. Further, for example, it is possible to reduce the possibility of corrosion without using a sealing agent made of an insulating resin material and reduce corrosion while reducing the manufacturing cost. Further, in a manner similar to the case illustrated in FIG. 4, since no steep step is generated on the conductor portion W1, it is possible to prevent a relatively large shear force from acting on the conductor portion W1 due to a steep step. The slit described above with reference to FIGS. 8 and 9 may be additionally provided. An expansion of the width of the slit 14 enables the insulator portion W2 to easily follow the conductor portion W1.

Second Embodiment

Figure 11:
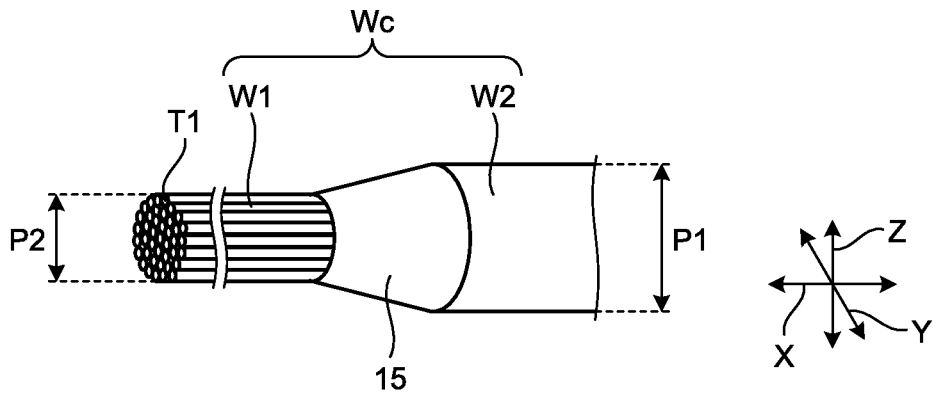
FIG. 11 is a partial perspective view illustrating another example of an end of an electric wire.

FIG. 11 is a partial perspective view illustrating another example of an end of an electric wire Wc. FIG. 11 illustrates the electric wire Wc before a crimp terminal 1 is crimped thereto. As illustrated in FIG. 11, an insulator portion W2 of the electric wire Wc includes a tapered portion 15. The tapered portion 15 is a part of the insulator portion W2 where the outer diameter gradually decreases toward a tip T1 of a conductor portion W1. The outer diameter of the insulator portion W2 is denoted by P1, and the outer diameter of the conductor portion W1 is denoted by P2. A part of the insulator portion W2 where the outer diameter changes from the outer diameter P1 to the outer diameter P2 corresponds to the tapered portion 15. The tapered portion 15 can be formed by stripping off the insulator portion W2 so that the outer diameter gradually decreases. The tapered portion 15 can be formed by, for example, using a device that applies a blade to the insulator portion W2 to strip off the covering or a device that applies laser light to the insulator portion W2 to remove the covering.

Figure 12:
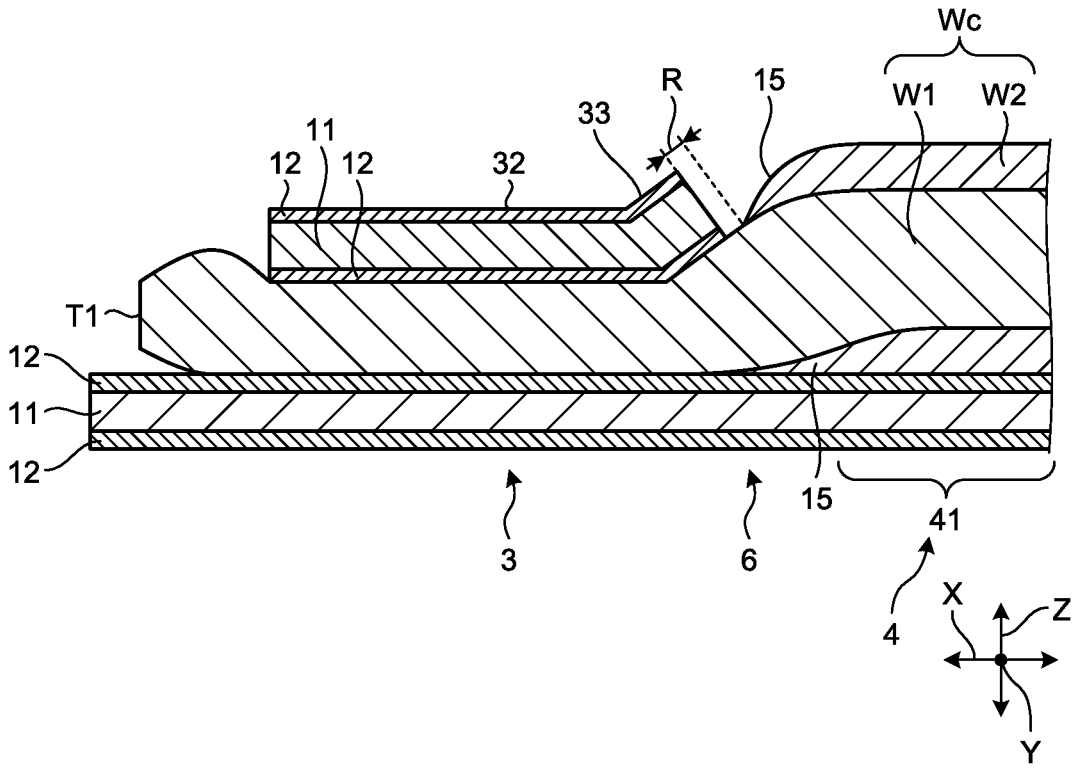
FIG. 12 is a sectional view illustrating a state in which the crimp terminal is crimped to the electric wire illustrated in FIG. 11.

FIG. 12 is a sectional view illustrating a state in which the crimp terminal 1 is crimped to the electric wire We illustrated in FIG. 11. FIG. 12 illustrates a section corresponding to the A-A section in FIG. 1. As illustrated in FIG. 12, the tapered portion 15 is in contact with a second base portion 41 and a second coupling portion 6 in a state in which a sheath crimp portion 4 is crimped to the insulator portion W2. That is, a part of the tapered portion 15 is in contact with the second base portion 41 in a state in which the sheath crimp portion 4 is crimped to the insulator portion W2. Further, a part of the tapered portion 15 is in contact with the second coupling portion 6 which couples a conductor crimp portion 3 and the sheath crimp portion 4 to each other in a state in which the sheath crimp portion 4 is crimped to the insulator portion W2. The outer diameter of the tapered portion 15 gradually decreases toward the tip T1 of the exposed conductor portion W1 between the conductor crimp portion 3 and the sheath crimp portion 4 in the extending direction of the electric wire Wc. In this case, the insulator portion W2 easily follows the conductor portion W1, and the position in the height direction Z changes along the surface of the conductor portion W1 by the tapered portion 15. In the state illustrated in FIG. 12, the insulator portion W2 and a bell-mouth portion 33 are close to each other, and an interval R therebetween is small. Thus, it is possible to reduce the exposed area of the conductor portion W1 to reduce the possibility of corrosion. Further, for example, it is possible to reduce the possibility of corrosion without using a sealing agent made of an insulating resin material and reduce corrosion while reducing the manufacturing cost. Further, according to the configuration of FIG. 12, no steep step is generated on the conductor portion W1. Thus, it is possible to prevent a relatively large shear force from acting on the conductor portion W1 due to a steep step.

The first barrel piece portions 32 described above may overlap each other or the distance from the base on the first base portion 31 side to the tip of one of the first barrel piece portions 32 may be longer than that of the other first barrel piece portion 32 in a state in which the first barrel piece portions 32 are crimped to the conductor portion W1. Similarly, the second barrel piece portions 42 described above may overlap each other or the distance from the base on the second base portion 41 side to the tip of one of the second barrel piece portions 42 may be longer than that of the other second barrel piece portion 42 in a state in which the second barrel piece portions 42 are crimped to the conductor portion W1.

Figure 13:
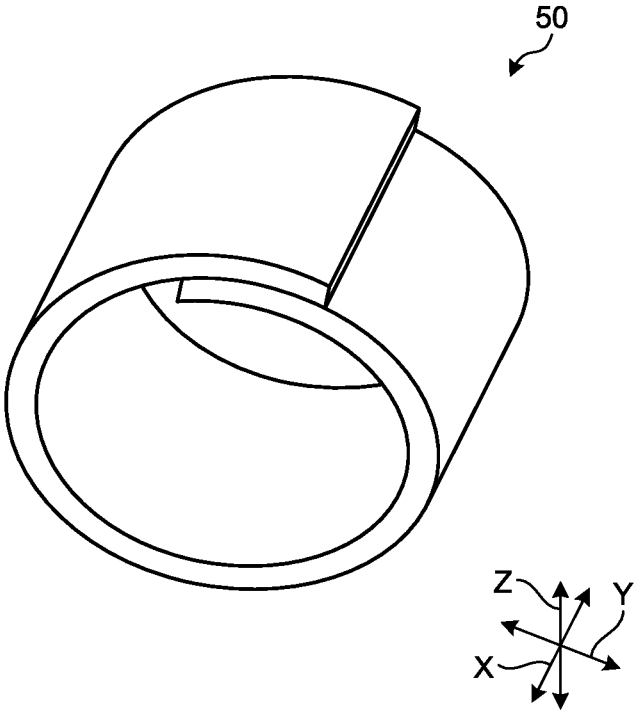
FIG. 13 is a diagram illustrating an example of an overlap crimping method.
Figure 14:
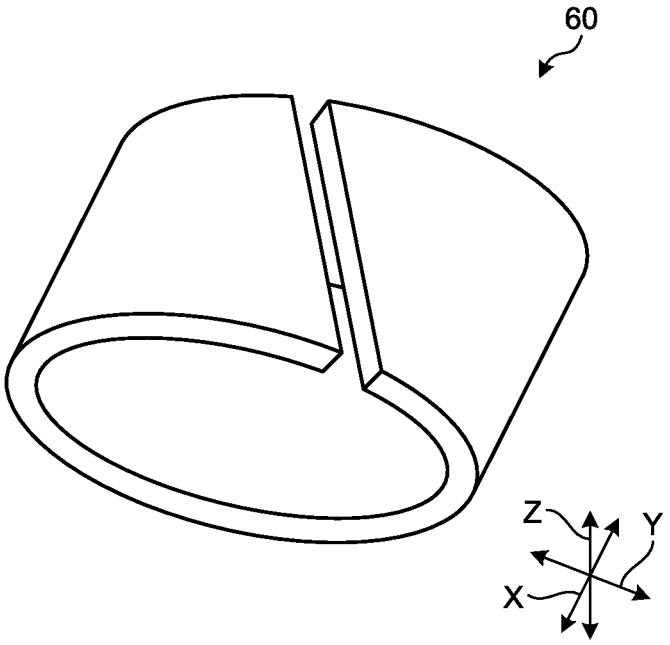
FIG. 14 is a diagram illustrating an example of a wrap-around crimping method.

FIG. 1 illustrates a case in which each of the pair of first barrel piece portions 32 and the pair of second barrel piece portions 42 bends toward the center, and the tips are forced to bite into the electric wire so that each of the pair of first barrel piece portions 32 and the pair of second barrel piece portions 42 is crimped into a B-shape, that is, crimped by a B-shaped crimping method. The present embodiments are not limited to such a case, and the crimping method may be another method. Specifically, the crimping method may be an overlap crimping method in which crimping is performed with tips of barrel piece portions 50 overlapping each other as illustrated in FIG. 13. Further, the crimping method may be a wraparound crimping method in which crimping is performed with oblique tips of barrel piece portions 60 close to each other as illustrated in FIG. 14. FIGS. 13 and 14 illustrate the pair of barrel piece portions and omit the illustration of an electric wire.

The electric wire with a terminal according to the present embodiments achieves an effect capable of reducing corrosion while reducing the manufacturing cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with a terminal comprising:

an electric wire that includes a conductor portion having conductivity, and an insulator portion covering an outside of the conductor portion and having an insulating property;

a terminal connection portion electrically connected to a counterpart terminal;

a conductor crimp portion that is crimped to the conductor portion exposed from the insulator portion; and a sheath crimp portion separated from the conductor crimp portion, and crimped to the insulator portion, wherein the sheath crimp portion includes a base portion on which the insulator portion is mounted, and a barrel piece portion extending from the base portion and crimped with the insulator portion wrapped between the barrel piece portion and the base portion, the insulator portion is in contact with the base portion and the barrel piece portion, and a distance from an end on the conductor crimp portion side to the conductor crimp portion is relatively short at a side in contact with the barrel piece portion, and a distance from an end on the conductor crimp portion side to the conductor crimp portion is relatively long at a side in contact with the base portion with respect to an extending direction of the electric wire, in a state in which the sheath crimp portion is crimped to the insulator portion, the insulator portion includes a cut-away portion at the side in contact with the base portion, the cut-away portion is located on the base portion side in a state in which the sheath crimp portion is crimped to the insulator portion, the insulator portion further includes a slit, and the slit is formed on the insulator portion at a position opposite to a position of the cut-away portion across the conductor portion, extends in a direction intersecting the extending direction of the electric wire, and has a depth less than a thickness of the insulator portion.

2. The electric wire with a terminal according to claim 1, wherein an end face of the cut-away portion on the conductor crimp portion side in the extending direction of the electric wire extends along a face inclined with respect to a face perpendicular to the extending direction.

* * * * *